US008308285B2

(12) United States Patent
Akihiro et al.

(10) Patent No.: US 8,308,285 B2
(45) Date of Patent: Nov. 13, 2012

(54) INKJET PRINTER

(75) Inventors: Naoki Akihiro, Ibaraki-ken (JP); Tomohiko Shimoda, Ibaraki-ken (JP); Yoshiyuki Okada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 186 days.

(21) Appl. No.: 12/857,611

(22) Filed: Aug. 17, 2010

(65) Prior Publication Data

US 2011/0050777 A1 Mar. 3, 2011

(30) Foreign Application Priority Data

Aug. 31, 2009 (JP) ..... P2009-199531

(51) Int. Cl.
*B41J 2/01* (2006.01)

(52) U.S. Cl. ..... 347/102

(58) Field of Classification Search ..... 347/16, 347/101, 102, 104
See application file for complete search history.

(56) References Cited

U.S. PATENT DOCUMENTS 6,168,269 B1 * 1/2001 Rasmussen et al. ..... 347/102
6,336,722 B1 * 1/2002 Wotton et al. ..... 347/102
7,216,968 B2 * 5/2007 Smith et al. ..... 347/102

FOREIGN PATENT DOCUMENTS

JP 2006-256855 A 9/2006

* cited by examiner

*Primary Examiner* — An Do
(74) *Attorney, Agent, or Firm* — Nath, Goldberg & Meyer; Jerald L. Meyer; Stanley N. Protigal

(57) ABSTRACT

An inkjet printer includes a printing unit, a transfer route, a heating chamber, and a heater. The printing unit ejects ink onto a sheet through nozzles of the inkjet heads. The transfer route transfers the sheet as printed at the printing unit. The heating chamber accommodates at least part of the transfer route to heat the sheet as transferred in the transfer route. The heater heats inside the heating chamber. The heating chamber is sectioned into sub-chambers along the transfer route, including a first sub-chamber to be heated by the heater and a second sub-chamber to be lower in temperature than the first sub-chamber and located between the printing unit and the first sub-chamber.

8 Claims, 5 Drawing Sheets

INKJET PRINTER

CROSS REFERENCE TO RELATED APPLICATION

This application is based upon and claims the benefit of priority from the prior Japanese Patent Application No. 2009-199531, filed on Aug. 31, 2009, the entire contents of which are incorporated herein by reference.

BACKGROUND OF THE INVENTION

1. Field of the Invention

The present invention relates to an inkjet printer.

2. Description of the Related Art

An inkjet printer for printing on sheets by ejecting ink containing moisture such as water-based ink from nozzles provided on inkjet heads as described in Japanese Patent Laid-Open Publication No. 2006-256855 sometimes causes a printed sheet to be rolled up. Such a deformation is caused by a situation that a printed surface of the sheet gets moist due to ink, whereby fiber of the sheet is swollen.

After printing and an elapse of a certain time, a deformation degree of the sheet is reduced due to a condition such as dryness of ink on the deformed sheet and penetration of moisture of ink into the other side of the printed surface. Such a reduction of the deformation degree of the sheet is accelerated in a high-temperature and high-humidity environment. In view of this, in order to fix the deformation of the printed sheet as soon as possible, an inkjet printer having a heating chamber for heating a printed sheet until the printed sheet is discharged has been known.

SUMMARY OF THE INVENTION

The inkjet printer having the heating chamber as described above may cause clogging of nozzles due to dryness of ink in the nozzles caused by high-temperature air leaking from the heating chamber and brought into contact with inkjet heads.

An object of the present invention is to provide an inkjet printer capable of preventing nozzles in inkjet heads from being clogged while reducing a deformation degree of printed sheets.

An aspect of the present invention is an inkjet printer comprising: a printing unit configured to eject ink onto a sheet from nozzles of inkjet heads; a transfer route configured to transfer the sheet as printed at the printing unit; a heating chamber configured to accommodate at least part of the transfer route to heat the sheet as transferred in the transfer route; and a heater configured to heat inside the heating chamber, wherein the heating chamber is sectioned into sub-chambers along the transfer route, including a first sub-chamber to be heated by the heater, and a second sub-chamber to be lower in temperature than the first sub-chamber and located between the printing unit and the first sub-chamber.

The second sub-chamber may be located upstream the printing unit in a sheet transfer direction of the transfer route.

The inkjet printer may further comprise a fan configured to introduce outer air into the second sub-chamber.

The inkjet printer may further comprise: a discharge port configured for communication with the heating chamber to discharge a sheet as transferred in the transfer route; a flipper movable between a first position to shift a traveling direction of a sheet as transferred in the transfer route for introducing the sheet to the discharge port and a second position to close the discharge port for keeping a sheet as transferred still in the transfer route; and a controller configured to control operation of the flipper. The transfer route may be a circulation transfer route configured to invert the sheet as printed at the printing unit and re-feed to the printing unit and the controller may work upon discharge of a sheet as transferred in the transfer route after change of a front edge direction of the sheet toward the discharge port by the flipper positioned at the first position to move the flipper toward the second position.

The controller may work upon discharge of a sheet as transferred in the transfer route during intervals between sheets to position the flipper at the second position.

The sub-chambers may include a third sub-chamber to be lower in temperature than the first sub-chamber and higher in temperature than the second sub-chamber and located between the first sub-chamber and the second sub-chamber upstream the printing unit.

The inkjet printer may further comprise: a discharge port configured for communication with the third sub-chamber to discharge a sheet as transferred in the transfer route; a flipper movable between a first position to shift a traveling direction of a sheet as transferred in the transfer route for introducing the sheet to the discharge port and a second position to close the discharge port for keeping a sheet as transferred still in the transfer route; and a controller configured to control operation of the flipper. The transfer route may be a circulation transfer route configured to invert the sheet as printed at the printing unit and re-feed to the printing unit, the second sub-chamber may be located upstream the printing unit in a sheet transfer direction of the transfer route, and the controller may work upon discharge of a sheet as transferred in the transfer route after change of a front edge direction of the sheet toward the discharge port by the flipper positioned at the first position to move the flipper toward the second position.

Air inside the third sub-chamber may be warmed up by air from the first sub-chamber, and air inside the second sub-chamber may be warmed up by air from the third sub-chamber.

According to the above-described configurations, it is possible to prevent the nozzles in the inkjet heads from being clogged while reducing the deformation degree of the printed sheets.

DETAILED DESCRIPTION OF THE EMBODIMENT

Figure 1:
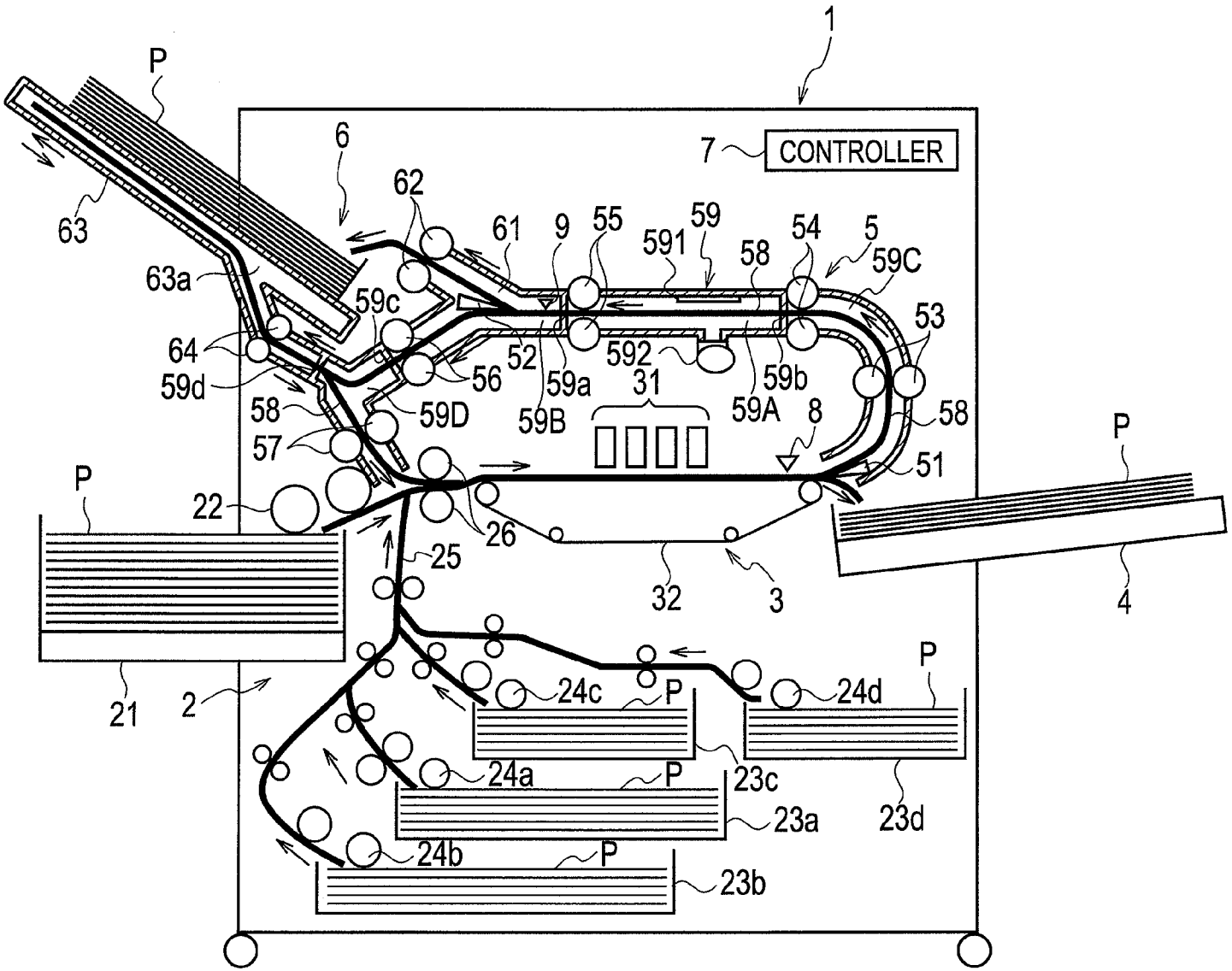
FIG. 1 is a schematic configuration diagram of an inkjet printer according to an embodiment of the present invention.

Hereinafter, a description will be made below in detail of an embodiment of the present invention with reference to the figures. In the following descriptions of the figures, common or similar members are indicated with common or similar reference numerals. It is noted that the figures are typically shown, and those configurations differ from the actual ones. In addition, it is certainly recognized that those figures have relationships and ratios of sizes that are mutually different from each figure.

FIG. 1 is a schematic configuration diagram of an inkjet printer 1 according to the embodiment of the present invention. As shown in FIG. 1, the inkjet printer 1 includes a sheet feed unit 2, a printing unit 3, a face-up sheet receiving tray 4, a circulating/inverting transfer unit 5, a face-down sheet receiving unit 6, and a controller 7.

The sheet feed unit 2 is provided being exposed outward from a casing of the inkjet printer 1. The sheet feed unit 2 includes a side sheet feed table 21 on which sheets P as a printing medium are stacked, a sheet feed roller 22 for picking up and delivering the sheets P one by one from the side sheet feed table 21, a plurality of sheet feed trays 23*a* to 23*d* on which the sheets P are stacked, respectively, a plurality of sheet feed rollers 24*a* to 24*d* for picking up and delivering the sheets P one by one from the sheet feed trays 23*a* to 23*d*, respectively, and register rollers 26 for correcting obliquity of the sheet P transferred along a sheet feed transfer route 25 from any of the side sheet feed table 21 and the sheet feed trays 23*a* to 23*d* and feeding the sheet P to the printing unit 3 at predetermined intervals.

The printing unit 3 has a plurality of line-type inkjet heads provided with a plurality of nozzles arranged in a direction perpendicular to a transfer direction of the sheet P. The printing unit 3 further includes a head unit 31 for printing images on the sheet P by eject ink from the nozzles of the inkjet heads, and a transfer unit 32 for transferring the sheet P delivered from the sheet feed unit 2 to the head unit 31.

The inkjet printer 1 according to the present embodiment uses ink that contains moisture. For example, the ink includes water-based ink and emulsion ink. The emulsion ink may be either an O/W type (oil-in-water type) or a W/O type (water-in-oil type).

The face-up sheet receiving tray 4 is provided downstream in the transfer direction of the sheet P with respect to the printing unit 3 and exposed outward from the casing of the inkjet printer 1. The face-up sheet receiving tray 4 receives the printed sheet P transferred by the transfer unit 32 so as to stack with the printed surface up.

The circulating/inverting transfer unit 5 includes flippers 51 and 52, and transfer rollers 53 to 57. The circulating/inverting transfer unit 5 functions to transfer the printed sheet P printed at the head unit 31 along a circulation transfer route 58 to introduce to the face-down sheet receiving unit 6 with the printed surface down. The circulating/inverting transfer unit 5 also functions to re-feed the sheet P to the printing unit 3 for both-side printing, for example.

The circulating/inverting transfer unit 5 includes a heating chamber 59 for heating the sheet P to be transferred along the circulation transfer route 58 in order to reduce a deformation degree of the rolled-up sheet P after printing. The heating chamber 59 is configured to house approximately a whole length of the circulation transfer route 58 therein. In the present embodiment, an upper wall and a lower wall of the heating chamber 59 function as a guide for the sheet P, so that the sheet P is transferred along the circulation transfer route 58 in the heating chamber 59 while being guided by the upper wall and the lower wall.

The heating chamber 59 is sectioned into a plurality of sub-chambers along the sheet transfer direction of the circulation transfer route 58 (circulating direction of the circulation transfer route 58), having a high-temperature sub-chamber 59A, middle-temperature sub-chambers 59B and 59C located adjacent to both sides of the high-temperature sub-chamber 59A, respectively, and a low-temperature sub-chamber 59D located adjacent to the middle-temperature sub-chamber 59B. Partition walls 59*a* and 59*b* located between the high-temperature sub-chamber 59A and the respective middle-temperature sub-chambers 59B and 59C and a partition wall 59*c* located between the middle-temperature sub-chamber 59B and the low-temperature sub-chamber 59D are provided with gaps through which the sheets P can path.

The high-temperature sub-chamber 59A is provided with a heater (a heating unit) 591 for heating inside the high-temperature sub-chamber 59A, and a fan 592 for equalizing temperature in the high-temperature sub-chamber 59A by agitating air heated by the heater 591.

The middle-temperature sub-chambers 59B and 59C are warmed up by air leaking from the high-temperature sub-chamber 59A. The low-temperature sub-chamber 59D is warmed up by air leaking from the middle-temperature sub-chamber 59B. The high-temperature sub-chamber 59A is heated to 35° C. or more, for example. The temperatures inside the middle-temperature sub-chambers 59B and 59C and the low-temperature sub-chamber 59C are gradually lowered in this order. In order to prevent the nozzles from being dried and clogged caused by high-temperature air heated by the heating chamber 59 and brought into contact with the nozzles of the inkjet heads, the low-temperature sub-chamber 59D is located at a position nearest the printing unit 3 upstream the printing unit 3 in the sheet transfer direction.

A control of temperature may be performed in each sub-chamber by providing heaters and fans in each sub-chamber. The heating chamber 59 is composed of resin, and the like. Meanwhile, a heat insulator may be adhered to at least a part of the heating chamber 59 for heat-retention.

Figure 2:
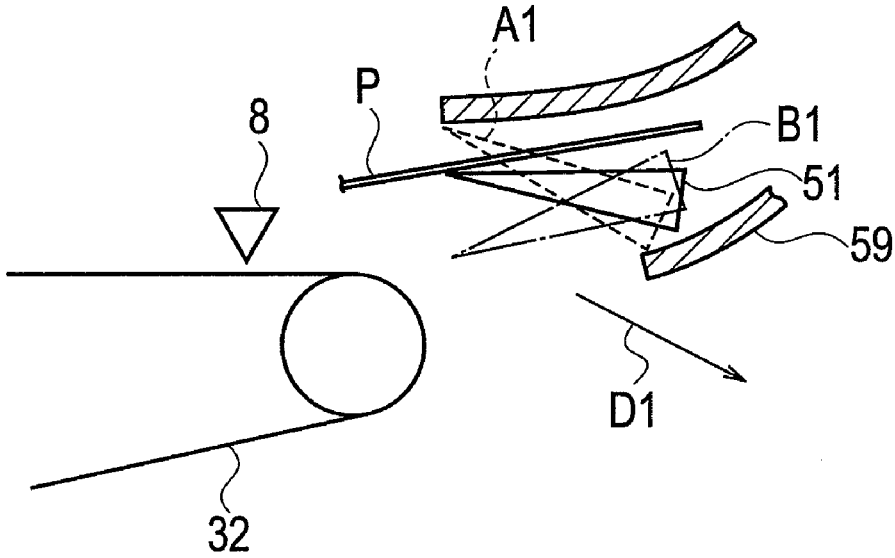
FIG. 2 is an enlarged partial view in a vicinity of an inlet of a heating chamber in the inkjet printer shown in FIG. 1.

The flipper 51 is arranged at an end portion of an inlet of the middle-temperature sub-chamber 59C in the heating chamber 59. The flipper 51 introduces the sheet P transferred by the transfer unit 32 to the face-up sheet receiving tray 4 or the circulation transfer route 58. As shown in FIG. 2, the flipper 51 is configured to be movable (switchable), by a drive source not shown in the figure, between a first sheet discharge introduction position A1 indicated by a dotted line and a first circulation transfer route introduction position B1 indicated by a chain line. An arrow indicated by a reference numeral D1 in FIG. 2 represents a sheet discharging direction.

The flipper 51 also functions as a valve for opening and closing the inlet of the heating chamber 59. When the flipper 51 is positioned at the first sheet discharge introduction position A1, the inlet of the heating chamber 59 is closed.

Figure 3:
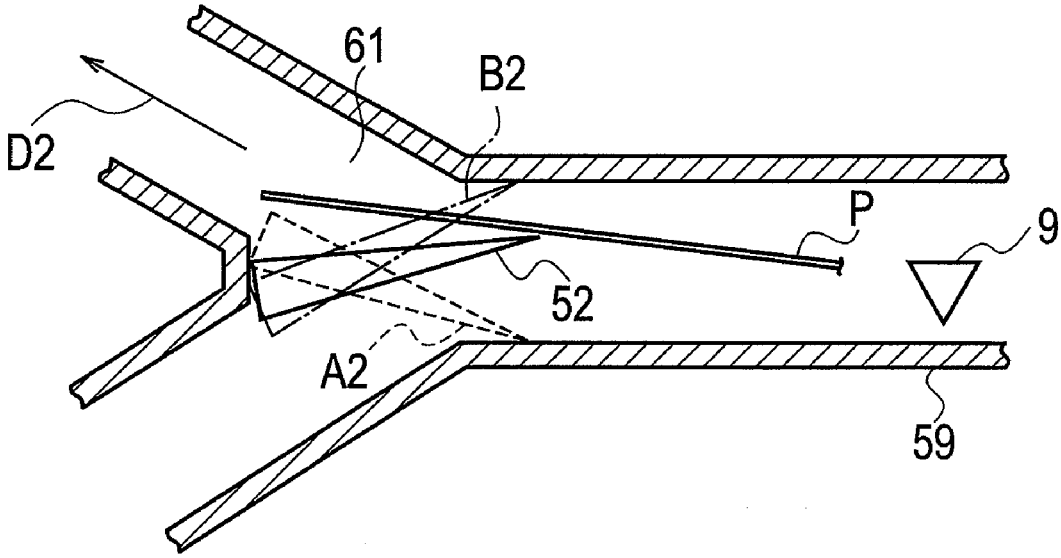
FIG. 3 is an enlarged partial view in a vicinity of a face-down sheet discharge port in the inkjet printer shown in FIG. 1.

The flipper 52 is arranged adjacent to a face-down sheet discharge port 61 described later being communicated with the heating chamber 59. The flipper 52 selects a route for introducing the sheet P transferred in the circulation transfer route 58 to the face-down sheet discharge port 61, or a route for keeping transferring the sheet P in the circulation transfer route 58. As shown in FIG. 3, the flipper 52 is configured to be movable (switchable), by a drive source not shown in the figure, between a second sheet discharge introduction position A2 (a first position) indicated by a dotted line and a second circulation transfer route introduction position B2 (a second position) indicated by a chain line. An arrow indicated by a reference numeral D2 in FIG. 3 represents a sheet discharging direction.

The flipper 52 also functions as a valve for opening and closing the face-down sheet discharge port 61. When the flipper 52 is positioned at the second circulation transfer route introduction position B2, the face-sown sheet discharge port 61 is closed.

In a position adjacent to the flipper 51 in a sheet transfer upstream direction, a transfer sensor 8 for detecting a front edge of the sheet P transferred by the transfer unit 32 is provided. In a position adjacent to the flipper 52 in a sheet transfer upstream direction, a transfer sensor 9 for detecting the front edge of the sheet P transferred in the circulation transfer route 58 is provided.

The face-sown sheet receiving unit 6 is communicated with the middle-temperature sub-chamber 59B in the heating chamber 59. The face-down sheet receiving unit 6 includes the face-down sheet discharge port 61 for discharging the printed sheet P transferred in the circulation transfer route 58 with the printed surface down, face-down sheet discharge rollers 62 for delivering the sheet P discharged from the face-sown sheet discharge port 61 to a face-down sheet receiving tray 63 described later, and the face-down sheet receiving tray 63 for stacking the sheet with the printed surface down.

The face-down sheet receiving tray 63 is provided at the opposite side to the face-up sheet receiving tray 4 and obliquely protruded from the casing of the inkjet printer 1. The printed sheet P discharged from the face-down sheet discharge port 61 is slid down along the inclination, and spontaneously and properly piled up on the face-down sheet receiving tray 63 due to a wall formed at a bottom portion of the inclination.

The face-down sheet receiving tray 63 is provided with a space 63*a* therein. Switchback transfer rollers 64 are arranged adjacent to an opening of the space 63*a*. When both side printing, the sheet P printed on one side is introduced to an inverting route branched from the circulation transfer route 58, and delivered into the space 63*a* by the switchback transfer rollers 64, so that the sheet P is switched back. A partition wall 59*d* having a gap through which the sheet P can path is provided adjacent to an opening communicated with the space 63*a* in the low-temperature sub-chamber 59D in the heating chamber 59.

The sheet P printed on one side and switched back is returned to the low-temperature sub-chamber 59D and transferred by the transfer rollers 57 to be introduced to the register rollers 26 with the printed surface down. Then, the sheet P is delivered to the printing unit 3 at a predetermined interval so as to print on the other side not printed.

The controller 7 is composed of a CPU (Central Processing Unit), a memory for storing a controlling program for the CPU, and the like, and controls each component provided in the printer. The controller 7 is connected to outputs of the transfer sensors 8 and 9. The controller 7 controls operations of the flippers 51 and 52 according to detection outputs from the transfer sensors 8 and 9.

Next, operations of the inkjet printer 1 will be explained. Each operation is performed according to a direction from the controller 7.

During a standby condition capable of printing, the heater 591 and the fan 592 are driven while the high-temperature sub-chamber 59A is maintained at a predetermined temperature. In accordance with the temperature of the high-temperature sub-chamber 59A, the middle-temperature sub-chambers 59B and 59C and the low-temperature sub-chamber 59D are also warmed up.

First, a case where the sheet P is discharged to the face-down sheet receiving tray 63 after one side printing will be explained. The printing unit 3 prints on the sheet P by eject ink from the head unit 31 while transferring the sheet P at a predetermined speed fed from the sheet feed unit 2 by the transfer unit 32.

After the printed sheet P is transferred by the transfer unit 32, the transfer sensor 8 detects the front edge of the sheet P. Then, the controller 7 starts to move the flipper 51 positioned at the first circulation transfer route introduction position B1 toward the first sheet discharge introduction position A1 after a predetermined period of time. The predetermined period of time is a preliminarily defined time between a point when the sensor 8 detects the front edge of the sheet P and a point when the traveling direction of the sheet P is shifted to a direction toward the circulation transfer route 58 by bringing the sheet P into contact with the flipper 51.

As shown in FIG. 2, the sheet P passes through the flipper 51 being in contact with the flipper 51 gradually moving from the first circulation transfer route introduction position B1 toward the first sheet discharge introduction position A1. After the sheet P passes through, the flipper 51 is positioned at the first sheet discharge introduction position A1, while the inlet of the heating chamber 59 is closed. When the front edge of the sheet P is detected by the transfer sensor 8, the controller 7 brings the flipper 51 back to the first circulation transfer route introduction position B1. After the predetermined period of time since the detection by the transfer sensor 8, the controller 7 starts to move the flipper 51 from the first circulation transfer route introduction position B1 toward the first sheet discharge introduction position A1 as described above.

Generally, the flipper 51 is operated only at a point when the necessity to switch the routes is occurred, and is kept being positioned at the first circulation transfer route introduction position B1 until the sheet P passes through. When a plurality of the sheets P are continuously printed, the flipper 51 is kept being positioned at the first circulation transfer route introduction position B1 until a series of the sheets to be printed completely pass through. On the other hand, the flipper 51 is operated while the sheet P passes through as described above, and at the same time, the inlet of the heating chamber 59 is closed by positioning the flipper 51 at the first sheet discharge introduction position A1 until the following sheet P arrives at the transfer sensor 8 (interval between sheets) in the present embodiment. Accordingly, it is possible to reduce outward flow of warm air from the middle-temperature sub-chamber 59C in the heating chamber 59 by controlling the operation of the flipper 51 as described above.

The sheet P introduced to the circulation transfer route 58 by the flipper 51 is heated while being transferred along the heating chamber 59. As a result, the degree of the deformation of the sheet P caused by printing by ink is reduced.

When the transfer sensor 9 detects the front edge of the sheet P transferred in the circulation transfer route 58, the controller 7 starts to move the flipper 52 positioned at the second sheet discharge introduction position A2 toward the second circulation transfer route introduction position B2 after a predetermined period of time. The predetermined period of time is a preliminarily defined time between a point when the sensor 9 detects the front edge of the sheet P and a point when the traveling direction of the sheet P is shifted to a direction toward the face-down sheet discharge port 61 by bringing the sheet P into contact with the flipper 52.

As shown in FIG. 3, the sheet P passes through the flipper 52 being in contact with the flipper 52 gradually moving from the second sheet discharge introduction position A2 toward the second circulation transfer route introduction position B2. After the sheet P passes through, the flipper 52 is positioned at the second circulation transfer route introduction position B2, while the face-down sheet discharge port 61 is closed. When the front edge of the transferred sheet P is detected by the transfer sensor 9, the controller 7 brings the flipper 52 back to the second sheet discharge introduction position A2.

After the predetermined period of time since the detection by the transfer sensor 9, the controller 7 starts to move the flipper 52 from the second sheet discharge introduction position A2 toward the second circulation transfer route introduction position B2 as described above.

By operating the flipper 52 while the sheet P passes through as described above, air in the heating chamber 59 flowing out from the face-down sheet discharge port 61 with the sheet P is reduced. In addition, the face-down sheet discharge port 61 is closed by positioning the flipper 52 at the second circulation transfer route introduction position B2 during the interval between sheets until the following sheet P arrives at the transfer sensor 9. Accordingly, it is possible to reduce outward flow of warm air of the middle-temperature sub-chamber 59B from the face-down sheet discharge port 61 by controlling the operation of the flipper 52 as described above.

The flippers 51 and 52 are composed of metal, resin, and the like. Meanwhile, it is possible to further prevent air from leaking from the heating chamber 59 by adhering an elastic member such as a sponge on the respective surfaces of the flippers 51 and 52.

The sheet P discharged from the face-down sheet discharge port 61 is delivered by the face-down sheet discharge rollers 62, so that the sheet P is stacked on the face-down sheet receiving tray 63.

When both side printing, the controller 7 keeps positioning the flipper 52 at the second circulation transfer route introduction position B2 even when the transfer sensor 9 detects the front edge of the sheet P printed on one side transferred in the circulation transfer route 58. The sheet P not discharged from the face-down discharge port 61 but passing through the flipper 52 is delivered by the switchback transfer rollers 64 in the inverting route, and introduced to the space 63*a* so that the sheet P is switched back. Then, the sheet P printed on one side is transferred by the transfer rollers 57, introduced to the register rollers 26 with the printed surface down, fed to the printing unit 3 by the register rollers 26, and printed on the other side not printed.

Similar to the case of one side printing, the sheet P printed on both sides is introduced to the circulation transfer route 58 by the flipper 51, transferred while being heated at the heating chamber 59, and discharged from the face-down sheet discharge port 61 by the flipper 52.

When discharging the sheet P to the face-up sheet receiving tray 4 at one side printing, the sheet P printed on one side is switched back, followed by feeding to the printing unit 3 similar to the case of both side printing described above. The sheet P printed on one side is transferred by the transfer unit 32 without performing printing by the printing unit 3. The controller 7 keeps positioning the flipper 51 at the first sheet discharge introduction position A1 even when the transfer sensor 8 detects the front edge of the sheet P printed on one side transferred by the transfer unit 32. Accordingly, the sheet P is introduced to the face-up sheet receiving tray 4 by the flipper 51.

Similarly, when discharging the sheet P to the face-up sheet receiving tray 4 at both side printing, the sheet P printed on both sides is transferred in the circulation transfer route 58 and switched back. Then, the sheet P is transferred by the transfer unit 32 without performing printing by the printing unit 3, and introduced to the face-up sheet receiving tray 4 by the flipper 51.

In the inkjet printer 1 as described above, when the sheet P is discharged to the face-up sheet receiving tray 4 at both side printing or even at one side printing having a process for heating the sheet P, the sheet P having passed through the heating chambers 59 is transferred toward the printing unit 3. Thus, air leaking from the heating chamber 59 tends to flow toward the head unit 31. When the nozzles of the inkjet heads come into contact with hot air, the nozzles may be clogged caused by drying ink in the nozzles.

However, the heating chamber 59 according to the inkjet printer 1 of the present embodiment is provided with the low-temperature sub-chamber 59D arranged at the nearest position to the printing unit 3 upstream the printing unit 3 in the sheet transfer direction. Therefore, the temperature of air flowing toward the head unit 31 from the heating chamber 59 is relatively low. Accordingly, it is possible to prevent the nozzles from being clogged due to dryness.

In addition, it is possible to prevent air from leaking from the middle-temperature sub-chambers 59 B and 59C in the heating chamber 59 by moving the flippers 51 and 52 in a closing direction during the passage of the sheet P, and by controlling the flippers 51 and 52 to close during the intervals in which the sheet P is not reaching to the flippers 51 and 52. Accordingly, it is possible to reduce consumed power for maintaining temperature in the heating chamber 59.

A reduction of the deformation degree of the sheet P is accelerated in a high-temperature and high-humidity environment. Therefore, a reduction of humidity in the heating chamber 59 is preferably prevented. By preventing air from leaking from the middle-temperature sub-chambers 59B and 59C by controlling the operations of the flippers 51 and 52 as described above, it is possible to reduce outward leak of moisture generated by heating the sheet P in the heating chamber 59, and prevent humidity in the heating chamber 59 from lowering.

MODIFIED EXAMPLE

Figure 4:
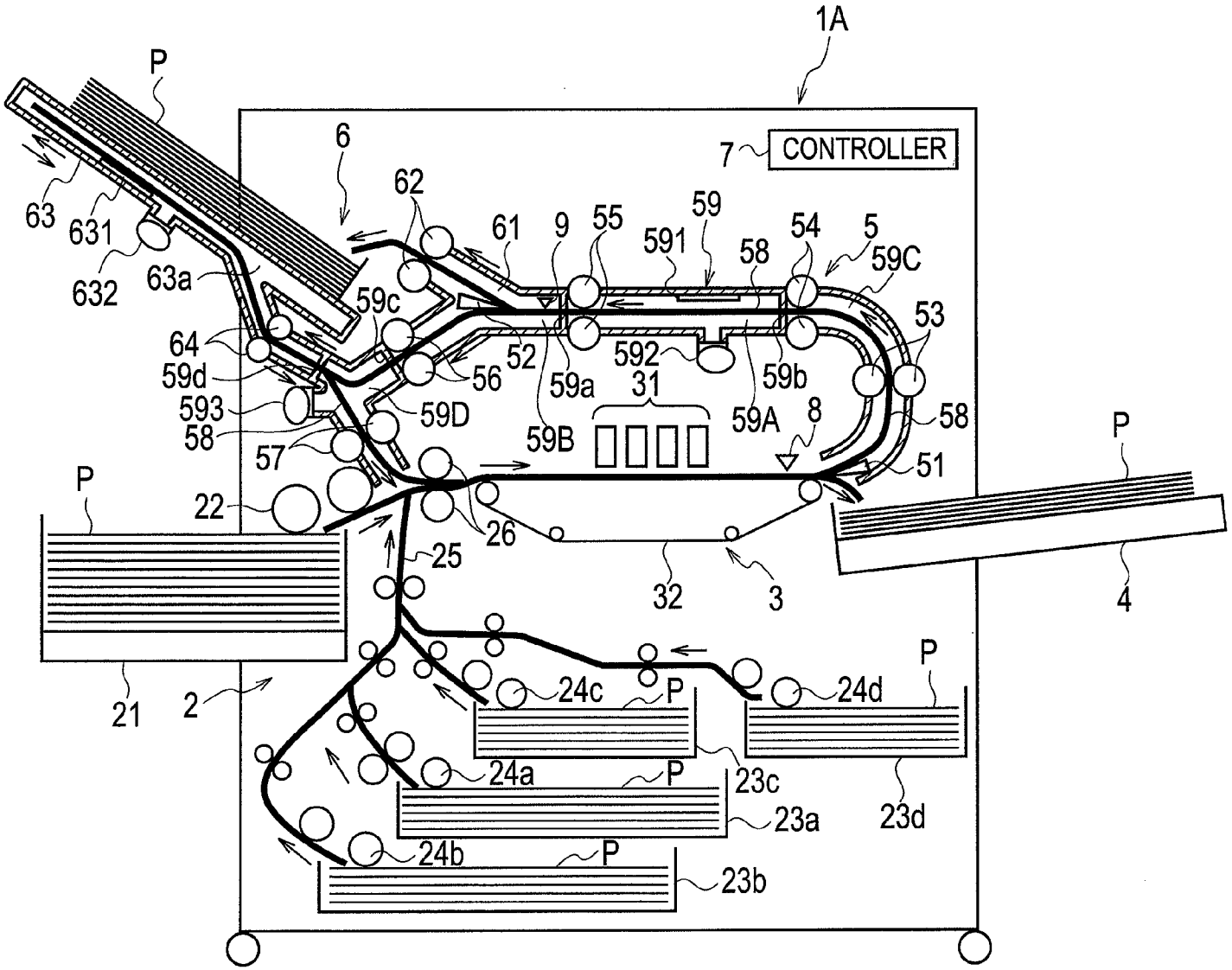
FIG. 4 is a schematic configuration diagram of an inkjet printer according to a modified example of the embodiment of the present invention.

FIG. 4 is a schematic configuration diagram of an inkjet printer 1A according to a modified example of the embodiment of the present invention. As shown in FIG. 4, The inkjet printer 1A according to the modified example has a configuration including a heater 631 for heating inside the space 63*a* for switchback, a fan 632 for equalizing temperature in the space 63*a* by agitating air heated by the heater 631, and a fan 593 for bringing outer air into the low-temperature sub-chamber 59D in the heating chamber 59, in addition to the configuration of the inkjet printer 1 shown in FIG. 1 in the above-described embodiment.

The inkjet printer 1A uses the space 63*a* for switchback as a heating chamber in addition to the heating chamber 59 due to the above-mentioned configuration. Accordingly, it is possible to reduce the deformation degree of the sheet P more effectively when both side printing and the like.

By using the space 63*a* for switchback as a heating chamber, high-temperature air leaking from the space 63*a* flows into the low-temperature sub-chamber 59D in the heating chamber 59. Meanwhile, it is possible to prevent the high-temperature air from flowing toward the head unit 31 of the printing unit 3 by introducing outer air into the low-temperature sub-chamber 59D by the fan 593.

The inkjet printer 1 shown in FIG. 1 can be also provided with the fan 593 for lowering temperature by bringing outer air into the low-temperature sub-chamber 59D in the heating chamber 59.

Figure 5:
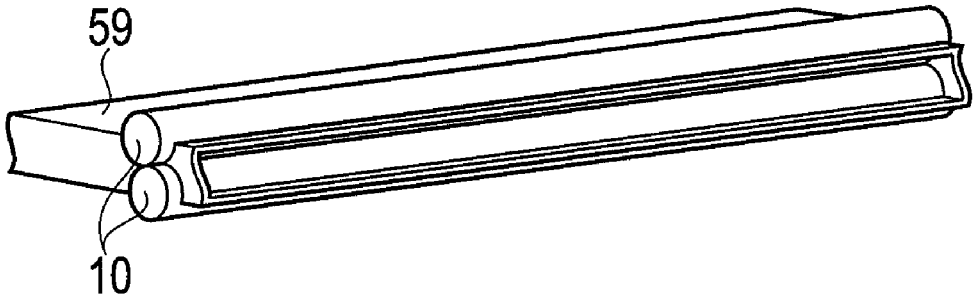
FIG. 5 is a view showing transfer rollers combining with a function as a partition wall of a heating chamber.

The inkjet printers 1 and 1A can employ transfer rollers 10 as shown in FIG. 5 transferring the sheet P and also functioning as a partition wall partitioning each sub-chamber in the heating chamber 59. The transfer rollers 10 are provided in a direction perpendicular to the sheet transfer direction of the circulation transfer route 58 extending transversely for the heating chamber 59. The transfer rollers 53 to 57 in FIGS. 1 and 4 are composed of a plurality of rollers provided having intervals in a direction perpendicular to the sheet transfer direction of the circulation transfer route 58. Meanwhile, the transfer rollers 10 as shown in FIG. 5 can be employed to function as a partition wall instead of the transfer rollers 53 to 56, and the partition walls 59*a* to 59*c* can be eliminated.

Figure 6:
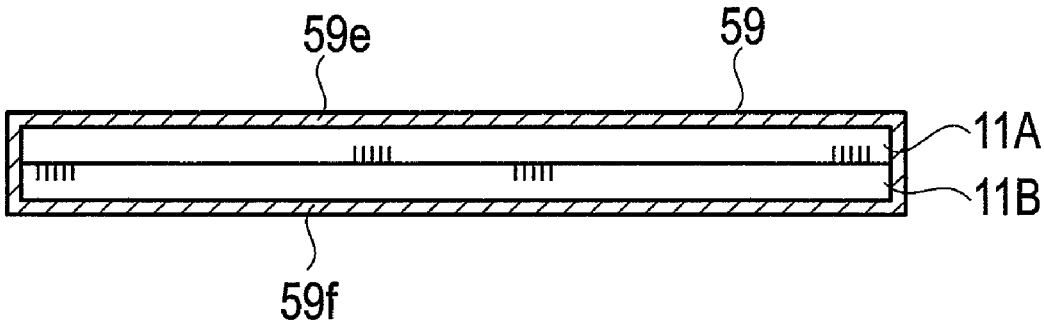
FIG. 6 is a view showing brushes as a partition wall of a heating chamber.

As the partition walls 59*a* to 59*d*, brushes 11A and 11B as shown in FIG. 6 can be employed. The brushes 11A and 11B are fixed to an upper wall 59*e* and a lower wall 59*f* of the heating chamber 59, respectively. The sheet P is transferred between the brushes 11A and 11B.

Figure 7:
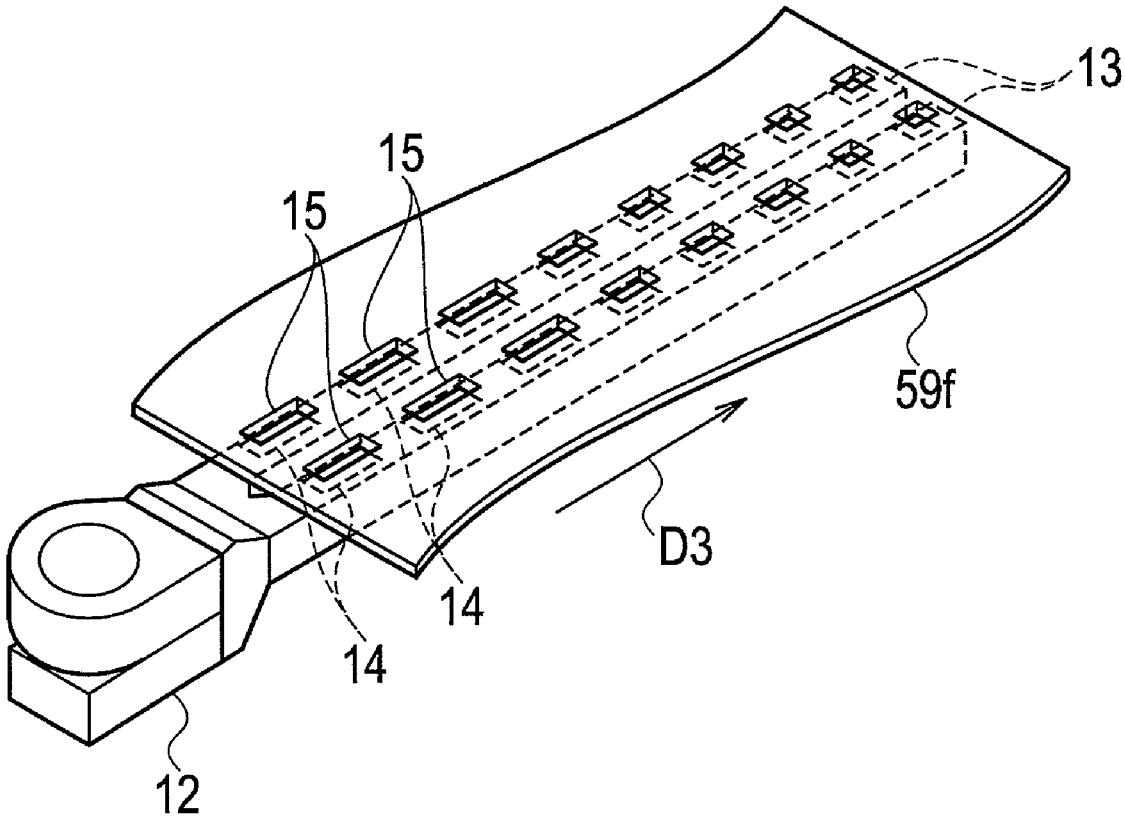
FIG. 7 is a view showing an example of a warm-air fan.

A warm-air fan 12 shown in FIG. 7 may be employed instead of the heater 591 and the fan 592. The warm-air fan 12 has linear warm-air ducts 13, which are provided with a plurality of outlets 14 for discharging warm air. An arrow indicated by a reference numeral D3 in FIG. 7 represents a direction of warm-air flow.

The warm-air fan 12 is arranged outside the lower wall 59*f* (or the upper wall 59*e*) of the heating chamber 59 so that the warm-air ducts 13 is located in a direction perpendicular to the sheet transfer direction of the circulating transfer path 58 and across the heating chamber 59. The lower wall 59*f* (or the upper wall 59*e*) of the heating chamber 59 on which the warm-air ducts 13 of the warm-air fan 12 are located is provided with a plurality of inlets 15 corresponding to the outlets 14.

Sizes of the outlets 14 and the inlets 15 are gradually reduced toward a front end portion of the warm-air ducts 13. At the front end portion of the warm-air ducts 13, warm air reversed by hitting front end surfaces of the warm-air ducts 13 is also discharged from the outlets 14. Therefore, the sizes of the outlets 14 and the inlets 15 at the front end portion are reduced so as to equalize the amount of warm-air flow flowing into the heating chamber 59. Accordingly, it is possible to further achieve equalization of temperature in the high-temperature sub-chamber 59A in the heating chamber 59.

A plurality of the warm-air fans 12 may be provided in the high-temperature sub-chamber 59A. In addition, the warm-air fan 12 may be employed instead of the heater 631 and the fan 632 provided in the space 63*a* for switchback in the inkjet printer 1A in FIG. 4.

An inkjet printer according to the embodiment of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. An inkjet printer comprising:

a printing unit configured to eject ink onto a sheet from nozzles of inkjet heads;

a transfer route configured to transfer the sheet as printed at the printing unit;

a heating chamber configured to accommodate at least part of the transfer route to heat the sheet as transferred in the transfer route; and a heater configured to heat inside the heating chamber, wherein the heating chamber is sectioned into sub-chambers along the transfer route in a direction of transferring the sheet, including a first sub-chamber to be heated by the heater, and a second sub-chamber to be lower in temperature than the first sub-chamber and located between the printing unit and the first sub-chamber.

2. The inkjet printer according to claim 1, wherein the second sub-chamber is located upstream the printing unit in a sheet transfer direction of the transfer route.

3. The inkjet printer according to claim 2, further comprising: a fan configured to introduce outer air into the second sub-chamber.

4. The inkjet printer according to claim 2, further comprising:

a discharge port configured for communication with the heating chamber to discharge a sheet as transferred in the transfer route;

a flipper movable between a first position to shift a traveling direction of a sheet as transferred in the transfer route for introducing the sheet to the discharge port and a second position to close the discharge port for keeping a sheet as transferred still in the transfer route; and a controller configured to control operation of the flipper, wherein the transfer route is a circulation transfer route configured to invert the sheet as printed at the printing unit and re-feed to the printing unit, and the controller works upon discharge of a sheet as transferred in the transfer route after change of a front edge direction of the sheet toward the discharge port by the flipper positioned at the first position to move the flipper toward the second position.

5. The inkjet printer according to claim 4, wherein the controller works upon discharge of a sheet as transferred in the transfer route during intervals between sheets to position the flipper at the second position.

6. The inkjet printer according to claim 1, wherein the sub-chambers include a third sub-chamber to be lower in temperature than the first sub-chamber and higher in temperature than the second sub-chamber and located between the first sub-chamber and the second sub-chamber upstream the printing unit.

7. The inkjet printer according to claim 6, further comprising:

a discharge port configured for communication with the third sub-chamber to discharge a sheet as transferred in the transfer route;

a flipper movable between a first position to shift a traveling direction of a sheet as transferred in the transfer route for introducing the sheet to the discharge port and a second position to close the discharge port for keeping a sheet as transferred still in the transfer route; and a controller configured to control operation of the flipper, wherein the transfer route is a circulation transfer route configured to invert the sheet as printed at the printing unit and re-feed to the printing unit, the second sub-chamber is located upstream the printing unit in a sheet transfer direction of the transfer route, and the controller works upon discharge of a sheet as transferred in the transfer route after change of a front edge direction of the sheet toward the discharge port by the flipper positioned at the first position to move the flipper toward the second position.

8. The inkjet printer according to claim 6, wherein air inside the third sub-chamber is warmed up by air from the first sub-chamber, and air inside the second sub-chamber is warmed up by air from the third sub-chamber.

* * * * *